US009459073B1

(12) United States Patent
Kloeppel

(10) Patent No.: US 9,459,073 B1
(45) Date of Patent: Oct. 4, 2016

(54) TACTICAL WEAPON WITH STOCK CONFIGURED TO RECEIVE A HANDGUN

(71) Applicant: Conner C. Kloeppel, Chesterfield, MO (US)

(72) Inventor: Conner C. Kloeppel, Chesterfield, MO (US)

( * ) Notice: Subject to any disclaimer, the term of this patent is extended or adjusted under 35 U.S.C. 154(b) by 0 days.

(21) Appl. No.: 14/850,009

(22) Filed: Sep. 10, 2015

Related U.S. Application Data

(60) Provisional application No. 62/048,882, filed on Sep. 11, 2014.

(51) Int. Cl.
*F41C 23/00* (2006.01)
*F41C 23/20* (2006.01)

(52) U.S. Cl.
CPC ..... *F41C 23/20* (2013.01)

(58) Field of Classification Search
CPC ..... F41C 23/00; F41C 23/04; F41C 23/06; F41C 23/08; F41C 23/10; F41C 23/12; F41C 23/14; F41C 23/20; F41C 23/22; F41C 7/00; F41C 7/11
USPC ..... D22/100, 103, 108, 111
See application file for complete search history.

(56) References Cited

U.S. PATENT DOCUMENTS 1,557,865 A * 10/1925 Neel ..... F41C 23/12 42/72
1,877,016 A * 9/1932 Munson ..... F41C 23/12 15/104.165
2,435,217 A * 2/1948 Howell, Jr. ..... F41C 23/12 124/84
2,441,487 A * 5/1948 Howard ..... F41C 23/04 42/72
D179,499 S * 1/1957 Sullivan ..... D22/103
3,618,248 A * 11/1971 Into et al. ..... F41C 23/22 42/71.01
4,512,101 A * 4/1985 Waterman, Jr. ..... F41C 23/18 42/71.01
4,989,358 A * 2/1991 Aronson ..... F41C 23/12 42/72
8,061,072 B1 * 11/2011 Crose ..... F41C 23/04 42/71.01
8,371,056 B1 * 2/2013 Baker ..... F41G 11/003 42/106
8,448,366 B2 * 5/2013 Faifer ..... F41C 23/04 42/71.01
8,720,100 B1 * 5/2014 Calvert ..... F41A 23/06 42/106

(Continued)

FOREIGN PATENT DOCUMENTS

FR 576440 A * 8/1924 ..... F41A 23/00
GB 113337 A * 2/1918 ..... F41C 23/04

OTHER PUBLICATIONS

"Model 1896 Mauser Broom Handle". <http://web.archive.org/web/20120102054112/http://www.kaisersbunker.com/dunkelblau/equipment/dbe08.htm>. Jan. 2, 2012.*

(Continued)

*Primary Examiner* — Gabriel Klein
(74) *Attorney, Agent, or Firm* — Matthew Himich

(57) ABSTRACT

A stock for a tactical weapon comprises a handgun and a receiver. The receiver may have a connection end configured to be connected to a tactical weapon, and a second end configured to receive a handgun. The receiver may be configured to releasably connect to a buffer bar of the tactical weapon. The receiver may be configured to be connected at different positions on the buffer bar thereby providing a variable overall length for the buffer bar and receiver when the receiver is installed on the buffer bar. The receiver and buffer bar may also be monolithically formed. The receiver may have a lever mechanism that actuates the safety of a handgun inserted therein or the receiver will serve as a trigger guard that prevents the handgun from being discharged once inserted into the receiver. The receiver may have a release configured to releasably secure the handgun in the receiver.

18 Claims, 6 Drawing Sheets

(56) References Cited

U.S. PATENT DOCUMENTS

| | | | | |
|---|---|---|---|---|
| 8,789,306 | B1 * | 7/2014 | Mazzoni | F41C 27/00 42/71.01 |
| 2003/0140541 | A1 * | 7/2003 | Kay | F41C 23/22 42/72 |
| 2008/0000131 | A1 * | 1/2008 | Oum | F41C 33/0227 42/71.01 |
| 2008/0110074 | A1 * | 5/2008 | Bucholtz | F41C 23/06 42/1.06 |
| 2011/0283584 | A1 * | 11/2011 | Walters | F41C 23/04 42/73 |
| 2012/0124882 | A1 * | 5/2012 | Lara | F41C 27/00 42/90 |
| 2014/0144061 | A1 * | 5/2014 | Bosco | F41C 33/001 42/94 |
| 2015/0276343 | A1 * | 10/2015 | Zusman | F41C 23/22 42/71.01 |
| 2015/0338187 | A1 * | 11/2015 | Priddy | F41C 23/22 42/71.01 |

OTHER PUBLICATIONS

"Mauser Shoulder Stock / Holster".http://web.archive.org/web/20120723011622/http://askmisterscience.com/1896mauserbackup/stocks.htm. Jul. 23, 2012.*

* cited by examiner

Prior Art

TACTICAL WEAPON WITH STOCK CONFIGURED TO RECEIVE A HANDGUN

CROSS-REFERENCE TO RELATED APPLICATIONS

This patent application claims priority to U.S. provisional patent application Ser. No. 62/048,882, filed Sep. 11, 2014, the entire disclosure of which is incorporated herein by reference.

BACKGROUND AND SUMMARY

The following disclosure relates to a tactical weapon with a stock that is configured to receive a handgun. The handgun is received in a holster structure, and once inserted, the handgun and the holster structure function as a stock for the tactical weapon. Should the user desire to utilize the handgun, the user may remove the handgun from the holster structure. The holster structure may have a safety actuating portion which activates the trigger lock and/or safety of the handgun when it is received in the holster structure. The holster structure may also serve as a trigger guard to prevent the handgun from discharging when it is received in the holster structure. When the handgun is removed from the holster structure, the safety actuating portion may release the trigger lock and/or the safety enabling the user to immediately use the handgun, or if the holster structure is functioning as a trigger guard, the handgun may or may not be immediately ready to use depending on whether the safety on the handgun was engaged when it was inserted into the holster structure. The holster structure may have a release configured to allow the handgun to be releasably secured in the holster structure. The holster structure may have a deployable secondary stock. When the handgun is removed from the holster structure, the deployable secondary stock may be pivoted into position and locked in place to allow the user to use the tactical weapon without the handgun in the holster structure functioning as a stock. The tactical weapon may be an assault rifle, shot gun or other firearm having a stock.

DETAILED DESCRIPTION

Figure 1:
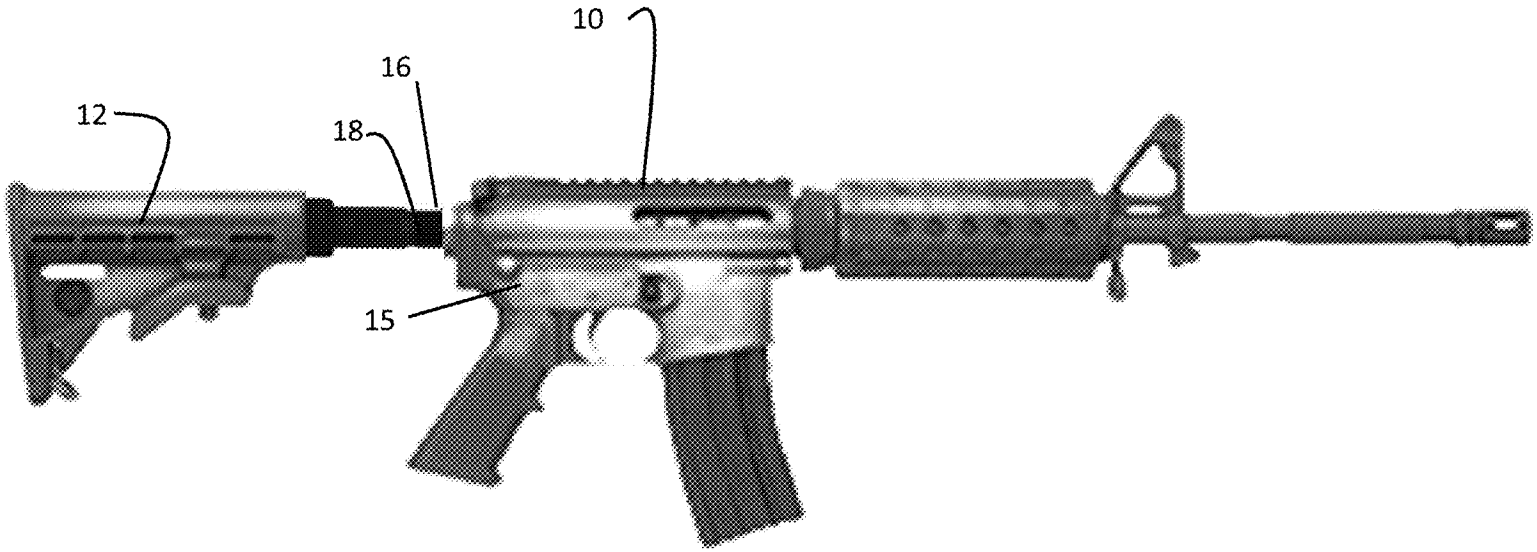
FIG. 1 is a view of a tactical weapon embodied in an assault rifle with a conventional stock assembled thereon.
Figure 2:
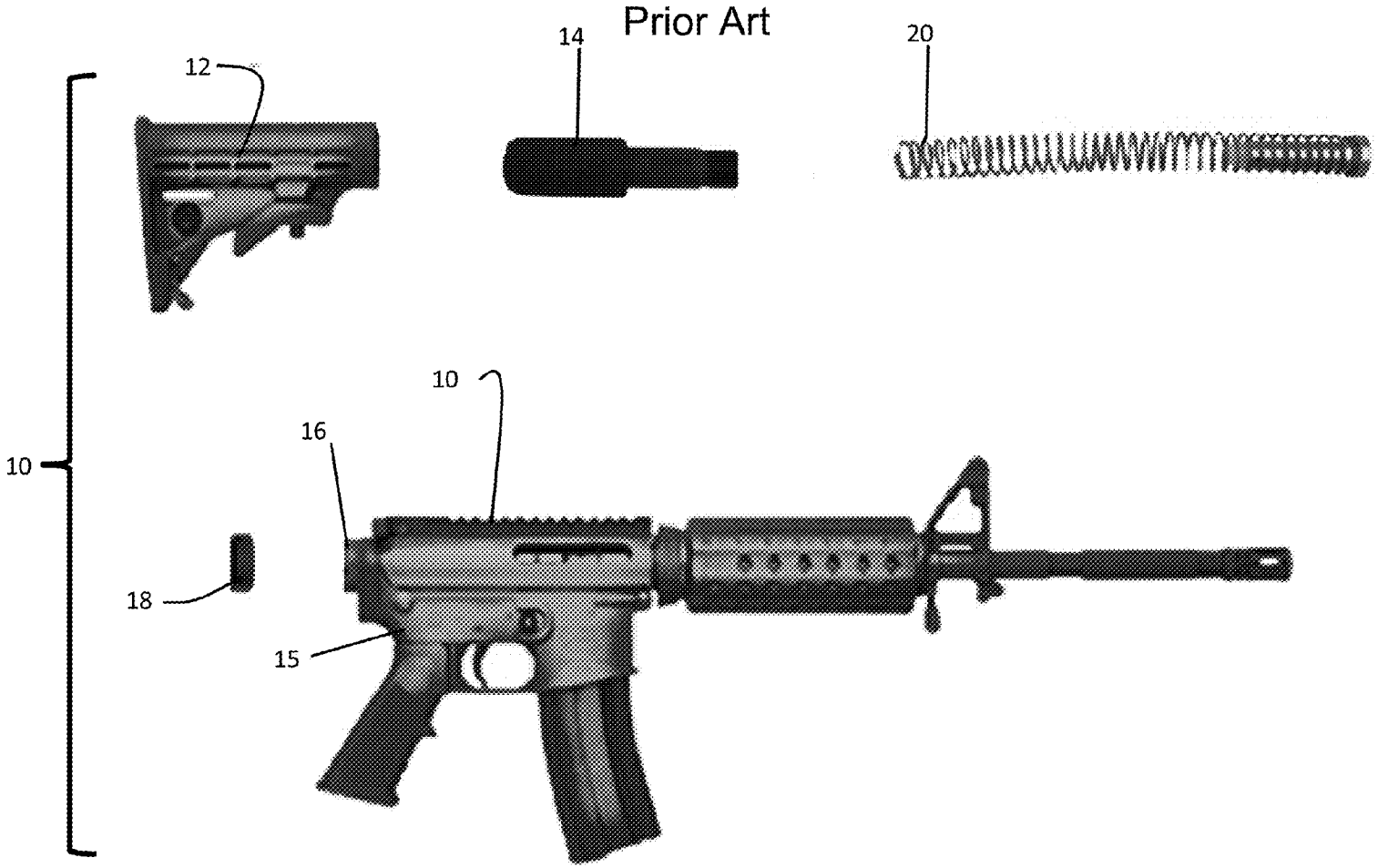
FIG. 2 is an exploded view of the assault rifle of FIG. 1 showing the stock, buffer tube, buffer tube spring and castle nut.

While the drawings show an assault rifle as the base tactical weapon, other base tactical weapons may be modified with the disclosed holster structure, such as a shot gun, depending upon the scenario and the desired base tactical weapon to be used. FIGS. 1 and 2 show a tactical weapon comprising an assault rifle 10. In FIG. 2, the conventional assault rifle has a stock 12 which may be releasably attached to the buffer tube 14. The buffer tube 14 attaches to a frame 15 of the assault rifle at a breech end 16 of the assault rifle with a castle nut 18. The buffer tube 14 has a spring 20 that is received in a hollow interior of the buffer tube.

Figure 3:
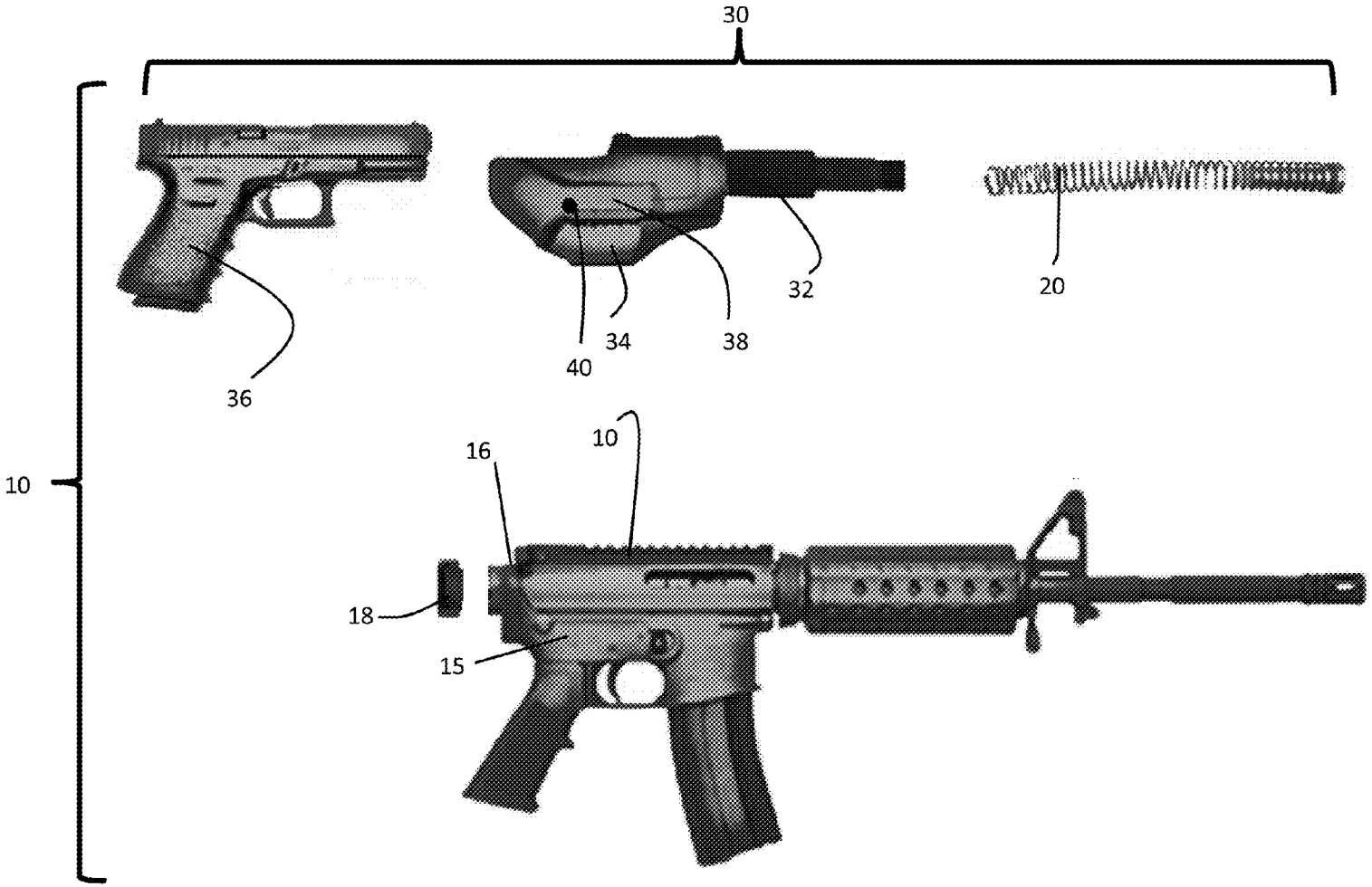
FIG. 3 is an exploded view of the assault rifle with the stock comprising a handgun and a holster structure configured to receive the handgun.
Figure 4:
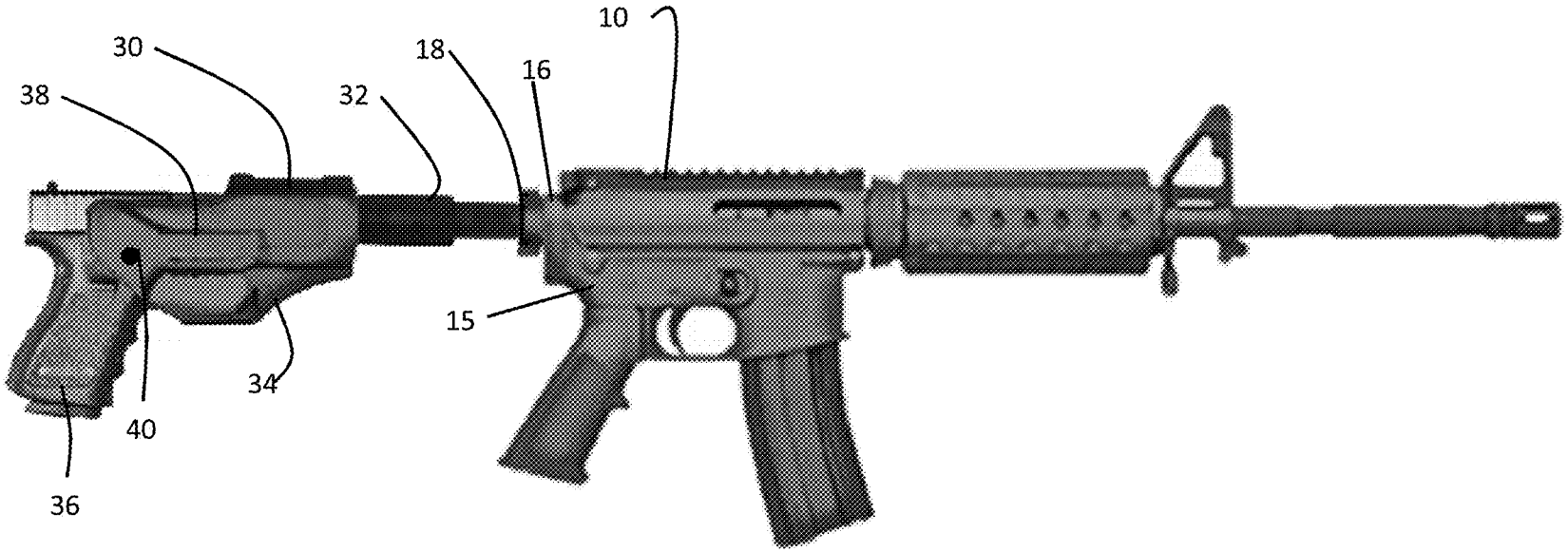
FIG. 4 is an assembled view of the assault rifle of FIG. 3.

FIG. 3 shows an exploded view of the assault rifle 10 with a modified stock 30. In FIG. 3, a buffer tube 32 includes a holster structure 34 configured to receive a handgun 36. The holster structure 34 may be releasably attached to the buffer tube 32. For instance, the holster structure 34 may be releasably attached to a conventional buffer tube (i.e., FIG. 2, '14') at a buffer tube holster structure attachment portion. In the alternative, the holster structure 34 may be releasably attached to a buffer tube 32 modified to allow releasable attachment with the holster structure. For instance, the holster structure may be releasably attached to a conventional buffer tube holster structure attachment portion (or a modified buffer tube holster structure attachment portion) in a manner to provide a telescoping arrangement to thereby allow the user to customize the length of the stock. In such an arrangement, the holster structure may have a tubular portion that receives the buffer tube holster structure attachment portion, and a lever may be provided on the holster structure to engage detents on the buffer tube holster structure attachment portion to provide a variable length of the stock.

In the alternative, the holster structure may be monolithically formed or otherwise integral (i.e., fixed in position) with a buffer tube portion. The buffer tube portion may receive a conventional buffer tube spring 20. The buffer tube portion may be attached to the breech of the assault rifle with the castle nut as a conventional buffer tube and a conventional tactical assault rifle. The buffer tube portion may have a conventional attachment mechanism with the breech end of the assault rifle so that it may be interchanged with a variety of tactical assault rifles. Depending upon the type of tactical weapon used as a base platform, the holster structure configured to receive the handgun may be modified to connect to the desired base platform tactical weapon as needed.

The holster structure 34 has an open end which is configured to receive the handgun 36. The holster structure 34 may have a handgun safety actuating mechanism 38 which engages the safety of the handgun to prevent the handgun from being discharged while inserted in the holster structure. In addition to or in the alternative, the holster structure 34 may also serve as the trigger guard and thereby prevent the handgun from being discharged while inserted in the holster structure. The handgun safety actuating mechanism 38 of the holster structure may allow release of the safety upon withdrawal of the handgun from the holster structure 34 thereby allowing the user to immediately discharge the handgun upon withdrawal of the handgun from the holster structure. If the holster structure 34 is serving as a trigger guard, the handgun may be immediately available for discharge if the safety was disengaged when inserted into the 34. The user may also disengage the safety upon withdrawal of the handgun from the as needed to prepare the handgun for use. The holster structure 34 may be configured to releasably secure the hand gun 36 in the holster structure. For instance, the holster structure 34 may have a release 40, for instance, a button or a lever that may be actuated to release the handgun 36 from the holster structure. The release 40 may be engaged when the handgun 36 is received in the 34 holster structure.

The holster structure 34 may be configure for specific handguns to be inserted therein. To allow versatility, a handgun specific holster structure may be releasably connected to a modified buffer tube 32 or a conventional buffer tube 14, thereby allowing the user the opportunity to use different holster structures and the same buffer tube for a variety of handgun models. For instance, a first holster structure may be configured to receive a Glock G-9 handgun and a second holster structure may configured to receive an M-9 handgun. The first holster structure (i.e., configured to receive a Glock G-9 handgun) may attach to the same buffer tube as the second holster structure (i.e., configured to receive an M-9 handgun). Accordingly, the buffer tube attachment portion of the holster structure may be the same for each specific holster structure to allow holster structures to be interchanged on the same buffer tube. In the alternative, a handgun specific, integral or monolithically-formed holster structure/buffer bar portion may be assembled with the assault rifle, as desired.

Once installed on the tactical weapon, for instance, the assault rifle 10 shown in the Figures, the handgun 36 inserted in holster structure 34 functions as an ordinary stock 30. Should the user desire to switch weapons and utilize the handgun, the user may actuate the release 40 to remove the handgun 36 from the holster structure 34. The handgun safety actuating mechanism of the holster structure may release the safety of the handgun enabling the user to begin to discharge the handgun upon its removal from the holster structure. In the alternative, if the holster structure 34 is acting as a trigger guard, the handgun may be immediately available for use upon its removal from the holster structure if the handgun safety was not engaged prior to insertion of the handgun into the holster structure 34.

Figure 6:
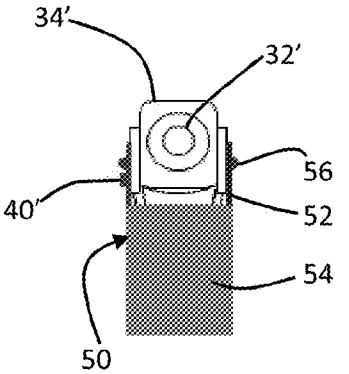
FIG. 6 is front view of the holster structure of FIG. 5.
Figure 8:
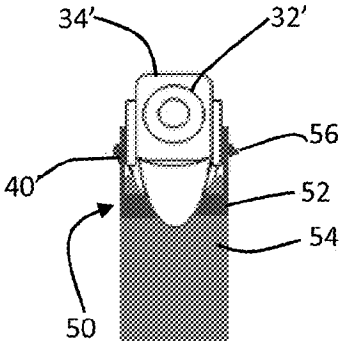
FIG. 8 is front view of the holster structure of FIG. 7.
Figure 5:
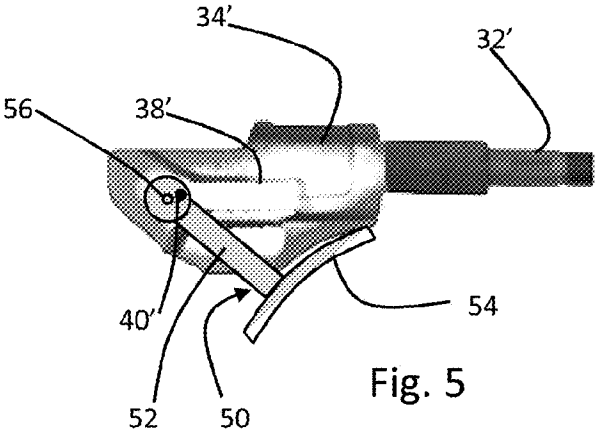
FIG. 5 is a side view of an alternate embodiment of a holster structure comprising a deployable secondary stock in a stored position.
Figure 7:
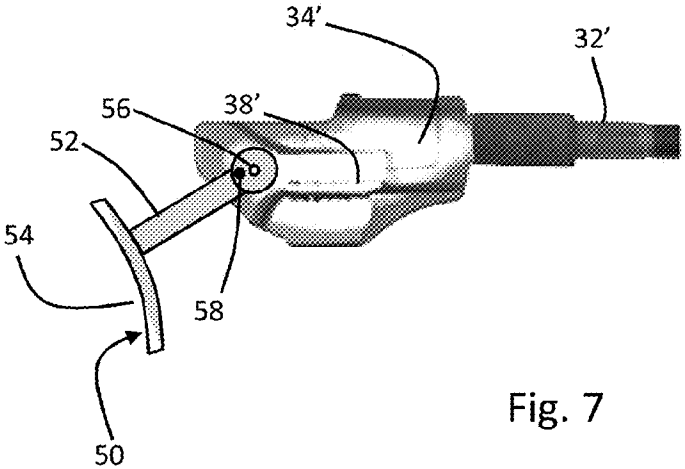
FIG. 7 is a side view of the holster structure of FIG. 5 in a deployed position.
Figure 9:
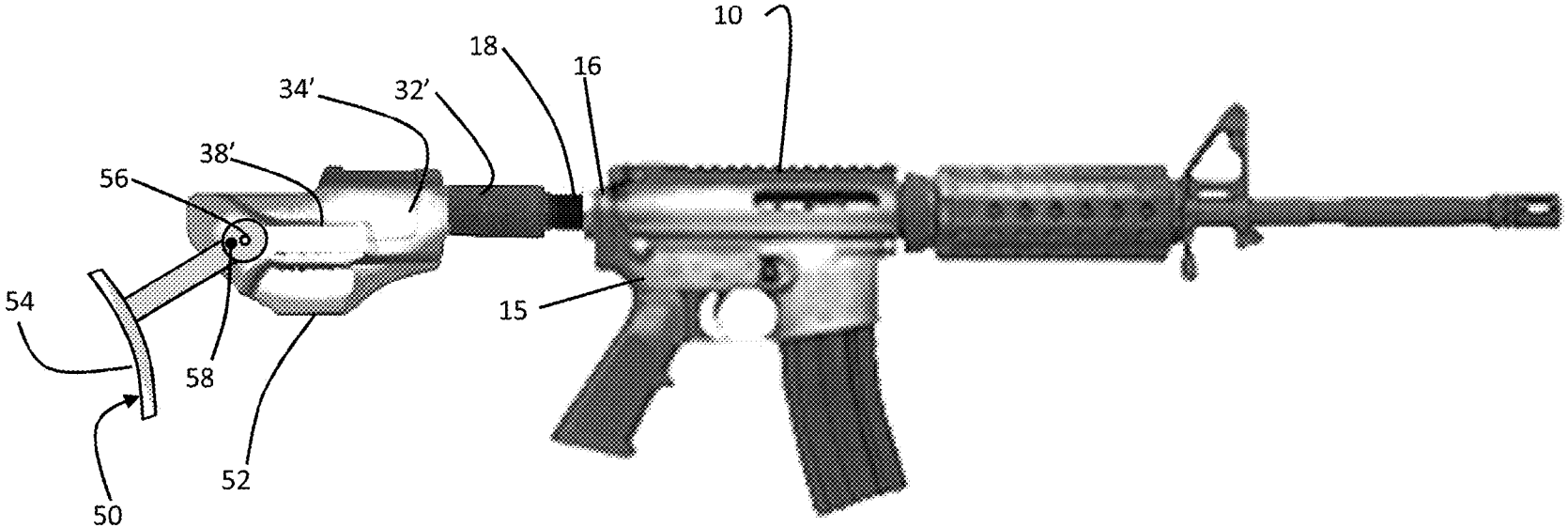
FIG. 9 is a side view of a tactical weapon embodied in an assault rifle with the holster structure of FIG. 7 assembled thereon.

FIGS. 5-9 show an alternate embodiment of a holster structure 34' for a tactical weapon. In FIGS. 5-9, the holster structure 34' is configured with a deployable secondary stock 50. The deployable secondary stock 50 allows the user to configure the holster structure 34' as a stock and use the tactical weapon 10 with the handgun removed 36. The holster structure 34' of FIGS. 5-9 comprises a yoke portion 52 and a shoulder rest portion 54. The yoke portion 52 may have a general U-shaped configuration with forks of the U-shaped yoke portion 52 extending about the holster structure 34'. The ends of the forks of the U-shaped yoke portion 52 may have a pivot connection 56 with the holster structure 34'. The secondary stock 50 may be movable between a stored position (FIGS. 5-6) and a deployed position (FIGS. 7-8). In the stored position, the secondary stock shoulder rest portion 54 may be placed adjacent to the holster structure 34'. In the deployed position, the secondary stock shoulder rest portion 54 may extend away from the holster structure 34'. In the deployed position, the secondary stock shoulder rest portion 54 may be positionable against the user of the tactical weapon to allow the user to in part support the tactical weapon with the secondary stock against the user. The pivot connection 56 between the yoke portion 52 and the holster structure 34' may be lockable in both the stored position as shown in FIGS. 5-6 and the deployed position as shown in FIGS. 7-8. While the drawings show the yoke portion 52 extending around the outer surfaces of the holster structure 34', the secondary stock 50 may also be pivotally connected to the interior of the holster structure. Also, instead of a pivot connection, the secondary stock may be drawn outward and away in a linear fashion from holster structure when moving the secondary stock to the deployed from the stored position (e.g., a locking telescopic extension).

The shoulder rest portion 54 may have a configuration which allows the shoulder rest portion to be nested within or adjacent to the outer shape of the holster structure 34'. As shown in FIG. 5, the shoulder rest portion 54 has a slightly arcuate appearance which allows the shoulder rest portion to fit under and adjacent to the holster structure 34' in the stored position and provide a shoulder rest in the deployed position. In the stored position, the secondary stock 50 may be configured to prevent interference with the handgun in the holster structure. Thus, the yoke portion 52 and the shoulder rest portion 54 may be arranged on the secondary stock 50 such that with the handgun received in the holster structure, a handgrip of the handgun is exposed from the holster structure and positionable against the user of the tactical weapon to allow the user to in part support the tactical weapon with the handgrip of the handgun against the user. With the secondary stock 50 in stored position, the yoke portion 52 and shoulder rest portion 54 may be positioned to allow the handgun to be inserted and removed from the holster structure. The secondary stock 50 may be removably attachable to the holster structure and/or allow for the secondary stock to be retrofitted to an existing holster structure or may be supplied with a holster structure, including as a kit with a holster structure.

The secondary stock 50 may be manually actuated by the user after removing the handgun from the holster structure 34'. In the alternative, the secondary stock 50 may be released from the stored position automatically upon removal of the handgun from the holster structure. For instance, actuation of the release 40' may simultaneously release the secondary stock 50 from the stored position. A spring (not shown, for instance, a torsion spring in the pivot connection 56) may urge secondary stock away from stored position toward the deployed position. Once the release 40' is actuated, the spring may urge the secondary stock from the stored position to the deployed position. The spring may be operatively connected between the holster structure and one or more forks of the U-shaped yoke portion 52, for instance, at the pivot connection 56. Once the secondary stock 50 is moved from the stored position, the secondary stock may be moved freely or with spring pressure to the deployed position. At the deployed position, the secondary stock 50 may be locked with the holster structure to prevent relative motion with the holster structure. The pivot connection 56 may include a spring-loaded pin 58 in the holster structure which engages a hole adjacent to the end of one or both forks of the U-Shaped yoke portion 52 to lock the secondary stock in place in the deployed position. The hole adjacent to the end of one or both forks of the U-Shaped yoke portion 52 may also cooperate with the release 40'. Alternatively, a lock or ratcheting pawl (not shown) may be provided between the holster structure and the secondary stock (for instance, at the pivoting connection 56) allowing the secondary stock to be locked in position at the deployed position. Once the secondary stock 50 is no longer needed, the secondary stock may be released from the deployed position and moved to the stored position to allow the handgun to be inserted into the holster structure 34'. Simultaneous insertion of the handgun into the holster structure 34' may cause pivoting of the secondary stock to the stored position. Full insertion of the handgun in the holster structure 34' may cause the secondary stock 50 to be locked into the stored position.

With the foregoing in mind, one may use the tactical weapon and holster structure in many ways. One may remove a first stock from a tactical weapon and install a second stock on the tactical weapon wherein the second stock comprising a handgun. The step of installing the second stock may comprise attaching a holster structure on a buffer tube of the tactical weapon wherein the holster structure is configured to receive the handgun. The step of attaching the holster structure on the buffer tube on the tactical weapon may comprise releasably attaching the holster structure to the buffer tube. The step of releasably attaching the holster structure to the buffer tube may include adjustably positioning the holster structure on the buffer tube. The step of installing a second stock may comprise removing a buffer tube from the tactical weapon and installing a second buffer bar on the tactical weapon. The step of installing the second stock may comprise attaching a holster structure on the second buffer bar on the tactical weapon wherein the holster structure is configured to receive a handgun. The step of attaching the holster structure on the second buffer tube on the tactical weapon may comprise releasably attaching the to the second buffer tube. The step of releasably attaching the holster structure to the second buffer tube may include adjustably positioning the holster structure on the second buffer tube. The step of installing the second stock may comprise removing a buffer tube from the tactical weapon and installing a second buffer tube on the tactical weapon wherein the second buffer tube has a holster structure integrally formed therewith that is configured to receive a handgun. The step of installing the second buffer tube on the tactical weapon may include the second buffer tube having a holster structure monolithically formed therewith that is configured to receive a handgun. The steps may also include installing a handgun in the holster structure. The holster structure may have a deployable secondary stock.

In view of the foregoing, it will be seen that the several advantages are achieved and attained. The embodiments were chosen and described in order to best explain the principles and their practical application to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A stock for a tactical weapon, wherein a barrel of the tactical weapon defines a longitudinal axis for the tactical weapon collinearly aligned with a breech end of the tactical weapon, the stock having first and second opposite ends with a length extending therebetween along a direction parallel to the longitudinal axis of the tactical weapon, the first end of the stock being configured to be attached to the tactical weapon and the second end of the stock comprising an opening into an interior of a holster structure, the opening of the holster structure being arranged transverse to the tactical weapon longitudinal axis, the holster structure being configured to receive a handgun through the holster structure opening with a handgrip of the handgun exposed from the holster structure opening and with a barrel of the handgun collinearly aligned with the longitudinal axis of the tactical weapon and the handgrip of the handgun positionable against the user of the tactical weapon to allow the user to in part support the tactical weapon with the handgrip of the handgun against the user.

2. The stock of claim 1 further comprising a deployable secondary stock comprising a shoulder rest portion, the deployable secondary stock being movable between a stored position and a deployed position, wherein in the stored position, the secondary stock shoulder rest portion is adjacent to the holster structure, and wherein in the deployed position, the secondary stock shoulder rest portion extends away from the holster structure and is positionable against the user of the tactical weapon to allow the user to in part support the tactical weapon with the secondary stock against the user.

3. The stock of claim 2 wherein the deployable secondary stock is pivotably connected with the holster structure.

4. The stock of claim 3 wherein the deployable secondary stock shoulder rest portion is operatively connected with a yoke portion extending about the holster structure.

5. A holster structure having a first end with a buffer tube portion configured to be connected to a breech end of a tactical weapon and a second end having an opening configured to receive a handgun, the holster structure second end opening being configured to allow a portion of the handgun to be inserted therethough with a handgrip of the handgun exposed from the holster structure and with a barrel of the handgun collinearly aligned with a longitudinal axis of the tactical weapon wherein the longitudinal axis of the tactical weapon is defined by the barrel of the tactical weapon and collinearly aligned with the breech end of the tactical weapon and the holster structure first end buffer tube portion such that the handgrip is positionable against the user of the tactical weapon to allow the user to in part support the tactical weapon with the handgrip against the user, and wherein the holster structure has a release to releasably secure the handgun in the holster structure.

6. The holster structure of claim 5 wherein the holster structure and buffer tube are monolithically formed.

7. The holster structure of claim 5 wherein the tactical weapon is an assault rifle.

8. The holster structure of claim 5, wherein the holster structure is configured to be connected at different positions on the buffer tube thereby providing a variable overall length for the buffer tube and holster structure when the holster structure is installed on the buffer tube.

9. The holster structure of claim 5 further comprising a deployable secondary stock having a shoulder rest portions the deployable secondary stock being movable between a stored position and a deployed position, wherein in the stored position, the secondary stock shoulder rest portion is adjacent to the holster structure, and wherein the deployed position, the secondary stock is positionable in a manner such that the secondary stock shoulder rest portion extends away from the holster structure and is positionable against the user of the tactical weapon to allow the user to in part support the tactical weapon with the secondary stock against the user.

10. The holster structure of claim 9 wherein the deployable secondary stock is pivotably connected with the holster structure.

11. The holster structure of claim 10 wherein the secondary stock shoulder rest portion is operatively connected with a yoke portion extending about the holster structure.

12. A kit comprising:

a holster structure configured to receive a handgun; and a buffer tube configured to connect to a tactical weapon, wherein a barrel of the tactical weapon defines a longitudinal axis for the tactical weapon collinearly aligned with a breech end of the tactical weapon;

wherein the holster structure has a first end configured to be connected with a buffer tube and a second end with an opening into a interior of the holster structure, the opening of the holster structure being arranged in a direction transverse to the buffer tube, the holster structure being configured to receive a handgun through the holster structure opening with a handgrip of the handgun exposed from the holster structure opening and with a barrel of the handgun collinearly aligned with the longitudinal axis of the tactical weapon and the buffer tube and the handgrip of the handgun positionable against the user of the tactical weapon to allow the user to in part support the tactical weapon with the handgrip of the handgun against the user.

13. The kit of claim 12 wherein the holster structure comprises a deployable secondary stock having a shoulder rest portion, the deployable secondary stock is movable between a stored position and a deployed position, wherein in the stored position, the secondary stock shoulder rest portion is adjacent to the holster structure, and wherein the deployed position, the secondary stock is positionable in a manner such that the secondary stock shoulder rest portion extends away from the holster structure and is positionable against the user of the tactical weapon to allow the user to in part support the tactical weapon with the secondary stock against the user.

14. The kit of claim 13 wherein the deployable secondary stock is pivotably connected with the holster structure.

15. The kit of claim 14 wherein the secondary stock shoulder rest portion is operatively connected with a yoke portion extending about the holster structure.

16. The kit of claim 12 further comprising a handgun.

17. The kit of claim 12 wherein the holster structure and buffer tube are integrally formed.

18. The kit of claim 12, wherein the holster structure is configured for a specific model of handgun.

* * * * *